US011404821B2

(12) United States Patent
Yang

(10) Patent No.: US 11,404,821 B2
(45) Date of Patent: Aug. 2, 2022

(54) FIRST CONNECTOR, SECOND CONNECTOR AND ELECTRICAL CONNECTOR ASSEMBLY

(71) Applicant: MOLEX LLC, Lisle, IL (US)

(72) Inventor: Yun-Fang Yang, Shanghai (CN)

(73) Assignee: MOLEX, LLC, Lisle, IL (US)

( * ) Notice: Subject to any disclaimer, the term of this patent is extended or adjusted under 35 U.S.C. 154(b) by 0 days.

(21) Appl. No.: 17/187,902

(22) Filed: Mar. 1, 2021

(65) Prior Publication Data

US 2021/0281012 A1 Sep. 9, 2021

(30) Foreign Application Priority Data

Mar. 5, 2020 (CN) ..... 202010146441.8

(51) Int. Cl.
*H01R 13/627* (2006.01)
*H01R 13/641* (2006.01)
(Continued)

(52) U.S. Cl.
CPC ..... *H01R 13/6272* (2013.01); *H01R 13/502* (2013.01); *H01R 13/639* (2013.01); *H01R 13/641* (2013.01); *H01R 13/6581* (2013.01)

(58) Field of Classification Search
CPC ..... H01R 13/65802; H01R 13/658; H01R 13/6581; H01R 13/6272; H01R 13/641; H01R 13/502; H01R 13/639
(Continued)

(56) References Cited

U.S. PATENT DOCUMENTS 4,634,204 A * 1/1987 Detter ..... H01R 13/641 439/352
5,591,041 A * 1/1997 Cecil, Jr. ..... H01R 13/639 439/352
(Continued)

FOREIGN PATENT DOCUMENTS

CN 1123097 C 10/2003

*Primary Examiner* — Gary F Paumen

(57) ABSTRACT

The present disclosure provides a first connector, a second connector and an electrical connector assembly. The first connector includes a connector main body, an elastic latching member and a position assurance slider. A positioning post and two locking protrusions protrude from an upper surface of the housing of the connector main body; two locking protruding portions protrude from inner sides of the two locking protrusions respectively toward each other. The elastic portion of the elastic latching member is suspended above the upper surface of the housing. The position assurance slider is positioned between the housing and the elastic latching member and can slide in a front-rear direction; during sliding of the locking portion of the position assurance slider in the front-rear direction, the locking portion cooperates with the locking protruding portion so that the elastic latching member is in a locking state or a non-locking state; when the elastic latching member is in the locking state, the tongue of the position assurance slider is positioned below the elastic portion to block the elastic portion from moving downwardly, so that prevent unlatching of the latching hook. The present disclosure is simple in structure and can realize firm locking.

15 Claims, 8 Drawing Sheets

(51) Int. Cl.
*H01R 13/502* (2006.01)
*H01R 13/6581* (2011.01)
*H01R 13/639* (2006.01)

(58) Field of Classification Search
USPC ..... 439/352, 607.27
See application file for complete search history.

(56) References Cited

U.S. PATENT DOCUMENTS

| | | | | |
|---|---|---|---|---|
| 6,068,507 | A * | 5/2000 | Popa | H01R 13/641 439/352 |
| 6,435,895 | B1 * | 8/2002 | Fink | H01R 13/6272 439/352 |
| 8,747,146 | B2 * | 6/2014 | Brown | H01R 13/639 439/489 |
| 2005/0042923 | A1 * | 2/2005 | Zhu | H01R 13/6583 439/607.27 |
| 2008/0139035 | A1 * | 6/2008 | Kim | H01R 13/641 439/352 |
| 2010/0035465 | A1 * | 2/2010 | Wang | H01R 13/502 439/541.5 |
| 2013/0059472 | A1 * | 3/2013 | Saito | H01R 13/648 439/607.27 |
| 2015/0295354 | A1 * | 10/2015 | Morello | H01R 13/6272 439/352 |
| 2017/0085038 | A1 * | 3/2017 | Duan | H01R 13/6585 |

* cited by examiner

FIRST CONNECTOR, SECOND CONNECTOR AND ELECTRICAL CONNECTOR ASSEMBLY

RELATED APPLICATION

The present application claims priority to Chinese Patent Application No. 202010146441.8 filed Mar. 5, 2020 which is incorporated by reference in its entirety.

TECHNICAL FIELD

The present disclosure relates to the field of connector, particularly relates to a first connector, a second connector and an electrical connector assembly which are simple in structure and can realize firm locking.

BACKGROUND

CN1123097C discloses a connector assembly, which includes: a first connector housing extending from a first end portion to an opposite second end portion and including a lug extending from a first connector housing wall; a second connector housing extending from one end portion to an opposite end portion and including a resilient locking tongue, the locking tongue including a first tongue portion extending from a fixed end attached to a second connector housing wall to a first free end and a second tongue portion extending from the first free end to an opposite second free end, the second free end including an engagement member, the second connector housing is slidably engaged with the first connector housing in a direction of a longitudinal axis, to engage and disengage the lug and the engagement member in an engaged mode and a disengaged mode respectively, the resilient locking tongue is structured and arranged such that movement of the first tongue portion toward the longitudinal axis causes movement of the engagement member away from the longitudinal axis in the disengaged mode, and release of the first tongue portion permits the engagement member to resile toward the longitudinal axis in the engaged mode; and a position assurance member movably attached to the second connector housing and structured and arranged such that in the engaged mode, movement of the position assurance member in a locking direction positions the position assurance member in relation to the locking tongue to sufficiently resist the movement of the first tongue portion towards, and the engagement member away from, the longitudinal axis to lock engagement of the lug and the engagement member in a locked mode.

In the structure of such a connector assembly, the engagement member of the resilient locking tongue is hidden inside the structure, the resilient locking tongue is integrally formed to the housing, extends along two directions via the housing wall, the structure is complicated, elasticity is not good. The position assurance member needs to be connected with other mating second connector housing so as to be capably locked and engaged, structure is complicated, and it is difficult to release after locked and engaged, which is not conveniently applied in circumstance that the first connector and the second connector needs to often be disengaged and engaged, and the resilient locking tongue of plastic is easily fractured after long term repeated assembling and disassembling and results in locking failure of the resilient locking tongue.

SUMMARY

A technical problem to be resolved by the present disclosure is to overcome the deficiency in the above existing technology and provide a first connector, a second connector and an electrical connector assembly which are simple in structure and can realize firm locking.

According to the present disclosure of an aspect, the present disclosure provides a first connector, which comprises a connector main body, an elastic latching member and a position assurance slider. The connector main body comprises a first connector assembly and a housing sheathing the first connector assembly therein; a positioning post protruding upwardly from an upper surface of the housing and two locking protrusions positioned at two sides of the positioning post on upper surface of the housing; two locking protruding portions protrude from inner sides of the two locking protrusions respectively. The elastic latching member comprises a fixing portion, an elastic portion extending forwardly from the fixing portion and a latching hook provided at a front end of the elastic portion; the fixing portion is provided with a positioning hole to allow the positioning post to be fixed therein; the elastic portion is suspended above the upper surface of the housing. The position assurance slider is positioned between the housing and the elastic latching member and can slide in a front-rear direction; the position assurance slider comprises a base, a tongue extending forwardly from the base and two locking portions provided at two sides of the tongue; the tongue is provided with a positioning groove which extends in the front-rear direction and allows the positioning post to be positioned therein and allows the positioning post to relatively slide therein; during sliding of the locking portion in the front-rear direction, the locking portion cooperates with the locking protruding portion so that the elastic latching member is in a locking state or a non-locking state; when the elastic latching member is in the locking state, the tongue is positioned below the elastic portion so as to prevent the elastic portion from moving downwardly, so that prevent unlatching of the latching hook According to the present disclosure of another aspect, the present disclosure further provides an electrical connector assembly comprising the first connector as above and the second connector which is matched with the first connector The second connector comprises a second connector assembly, a fixing shell used to fix the second connector assembly and an outer shielding shell sheathing the fixing shell therein, a locking cavity is formed in a front end of the outer shielding shell, a top portion of the outer shielding shell is provided with a latching aperture; when the first connector and the second connector is mated with each other, a front end of the housing of the first connector is inserted into the locking cavity, the latching hook of the elastic latching member is latched upwardly with the latching aperture, so that the first connector and the second connector is locked together.

According to the present disclosure of still another aspect, the present disclosure further provides a second connector comprising a second connector assembly, a fixing shell, and an outer shielding shell. The second connector assembly comprises an insulating base, a plurality of conductive terminal fixed to the insulating base and a metal shell sheathing the insulating base therein; a fixing rib bends outwardly from each of two sides of the metal shell. The fixing shell is fixed to the second connector assembly, the fixing shell is provided with a receiving hole extending in the front-rear direction, two sides of the fixing shell each are provided with a fixing groove; a front end of the metal shell is received in the receiving hole, the fixing rib of the metal shell is inserted into the corresponding fixing groove. The outer shielding shell sheathes the fixing shell therein.

According to the present disclosure of yet another aspect, the present disclosure further provides an electrical connector assembly comprising the first connector as above and the second connector which is matched with the first connector. The second connector comprises a second connector assembly, a fixing shell used to fix the second connector assembly and an outer shielding shell sheathing the fixing shell therein, a locking cavity is formed in a front end of the outer shielding shell, a protruding plate extends forwardly from the fixing shell, the protruding plate is provided with at least one mistake proof groove; when the first connector and the second connector are mated with each other, a front end of the housing of the first connector is inserted into the locking cavity inside; at least one mistake proof rib protrudes from the housing of the first connector, the at least one mistake proof rib is correspondingly inserted into the at least one mistake proof groove.

In comparison with prior art, the present disclosure at least has following advantage: in the first connector, using the latching hook of the elastic latching member realizes firm connection with the latching aperture of the second connector which mates with the first connector; by adjusting the position of the position assurance slider in the front-rear direction, the elastic latching member can be allowed to be in the locking state or is in the non-locking state. In the locking state, it assures that the latching hook does not separate from the mated second connector, realizes firm locking connection. In the non-locking state, by pressing the elastic portion down, the latching connection between the latching hook and the latching aperture of the second connector can be released, which facilitate separation of the first connector and the second connector from each other.

The elastic latching member and the position assurance slider are positioned by the positioning post and the locking protrusions protruding from the housing, which makes the structure simple and facilitates assembling. The fixing portion of the elastic latching member is mounted on the housing, the elastic portion is suspended above the housing, in comparison with a latching structure which is integrally provided on a housing, the elastic latching member made of a metal has better elasticity and latching strength, which facilitates realization of firmer locking connection. By the sliding fit between the positioning groove of the position assurance slider and the positioning post, the position assurance slider can realize stable sliding in the front-rear direction, by cooperation between the locking portion of the position assurance slider and the locking protrusion, the position of the position assurance slider in the front-rear direction can be fixed, firmness of the locking connection is assured.

DETAILED DESCRIPTION OF THE PREFERRED EMBODIMENTS

Figure 1:
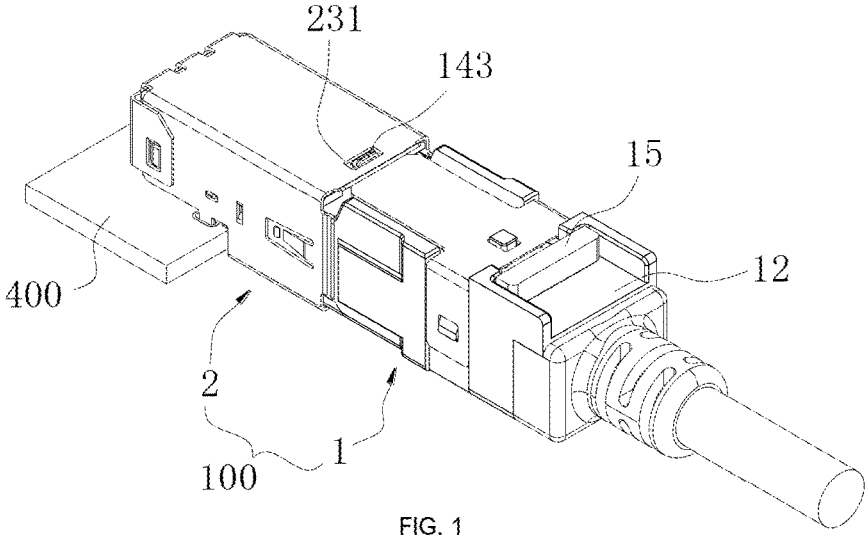
FIG. 1 is a perspective view a preferred embodiment of an electrical connector assembly of the present disclosure, in which the electrical connector assembly is engaged together and in a locking state.
Figure 2:
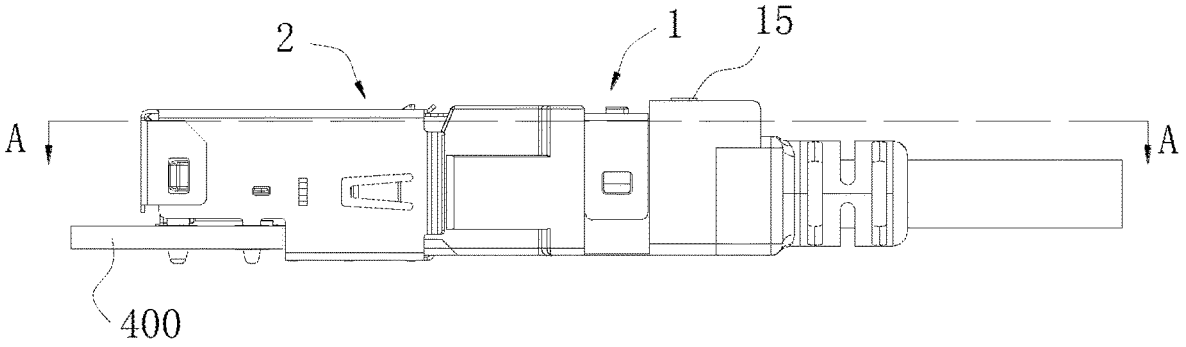
FIG. 2 is a front view of FIG. 1.

While the present disclosure may be susceptible to embodiments in different forms, there are shown in the figures, and will be described herein in detail, are only specific embodiments, with the understanding that the present disclosure is to be considered as an exemplification of the principles of the present disclosure, and is not intended to limit the present disclosure to that as illustrated.

As such, references to a feature are intended to describe a feature of an embodiment of the present disclosure do not to imply that every embodiment thereof must have the described feature. Furthermore, it should be noted that the description illustrates a number of features. While certain features may be combined together to illustrate potential system designs, those features may also be used in other combinations not expressly described. Thus, the described combinations are not intended to be limiting, unless otherwise noted.

In the embodiments illustrated in the figures, representations of directions such as up, down, left, right, front and rear, used for explaining the structure and movement of the various components of the present disclosure, are not absolute, but relative. These representations are appropriate when the components are in the position shown in the figures. If the description of the position of the components changes, however, these representations are to be changed accordingly.

Hereinafter, preferred embodiments of the present disclosure are further described in detail in combination with the figures of the present disclosure.

Referring to FIG. 1 to FIG. 9, the preferred embodiment provides an electrical connector assembly 100 which includes a first connector 1 and a second connector 2 matched with the first connector 1. The first connector 1 may be correspondingly mated with the second connector 2, and in the preferred embodiment, the first connector 1 is provided with a latching hook 143, and the second connector 2 is provided with a latching aperture 231 to cooperate with the latching hook 143, the latching hook 143 correspondingly latches with the latching aperture 231, so that electrical connector assembly 100 may be locked together.

It is noted that, in other embodiments not shown, the latching aperture 231 provided on the second connector 2 also may be any other structure form which can latch with the latching hook 143, for example, a latching structure may be provided on the second connector 2 to realize latching with the latching hook 143.

In the preferred embodiment, the first connector 1 is provided with a position assurance slider 15, a position of the position assurance slider 15 in a front-rear direction can be adjusted, so that when the first connector 1 and the second connector 2 are latched together, a locking state as shown in FIG. 1 to FIG. 4 *i* or a non-locking state as shown in FIG. 5 to FIG. 8 can be further determined.

In the locking state, the position of the position assurance slider 15 may prevent disengagement of the latching hook 143 and the latching aperture 231, so that it may prevent locking from being released due to unintentional hit, make the first connector 1 and the second connector 2 firmly locked together, promote reliability of an electrical connection between the first connector 1 and the second connector 2, and be applicable to an operating circumstance with stronger vibration.

Figure 9:
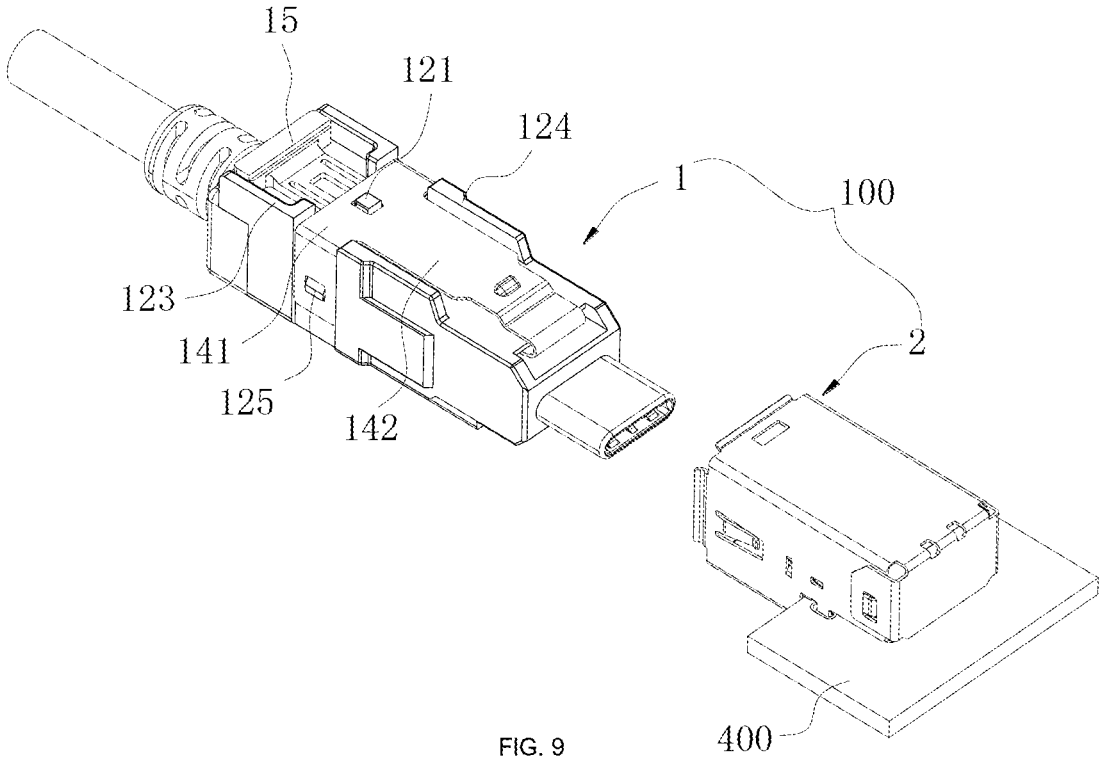
FIG. 9 is a schematic view of the electrical connector assembly of FIG. 1 in a separated state.

In the non-locking state, the position assurance slider 15 does not block a downward movement of the latching hook 143, the latching hook 143 and the latching aperture 231 may be separated from each other by appropriately detaching operation, so as to facilitate releasing connection of the first connector 1 and the second connector 2 to be presented on a state as shown in FIG. 9.

As shown in FIG. 9, in the preferred embodiment, the first connector 1 is a cable connector with a USB-C plug and is applied to a cable end. And the second connector 2 is a USB-C receptacle connector which may correspondingly mate with the first connector 1, preferably be used to an electronic device (not shown), the second connector 2 is soldered on a circuit board 400 of the electronic device.

It may be understood that, in the preferred embodiment, a technical solution to realize locking by cooperation between the latching hook 143 and the latching aperture 231 and the position of the position assurance slider 15 do not limit an interface form of the electrical connection. In other embodiments not shown, the first connector 1 and the second connector 2 is not limited to the USB-C form in the interface, further may be a connector with USB2.0 form, HDMI form, lighting form and the like.

Referring to FIG. 10 to FIG. 14, hereinafter specific structures of the first connector 1 and the second connector 2 are respectively further described in order to better understand present technical solution.

For sake of convenience of description, a direction in which an end of the first connector 1 and an end of the second connector 2 mate with each other is defined as "front", a direction relative to an opposite end is defined as "rear".

Figure 10:
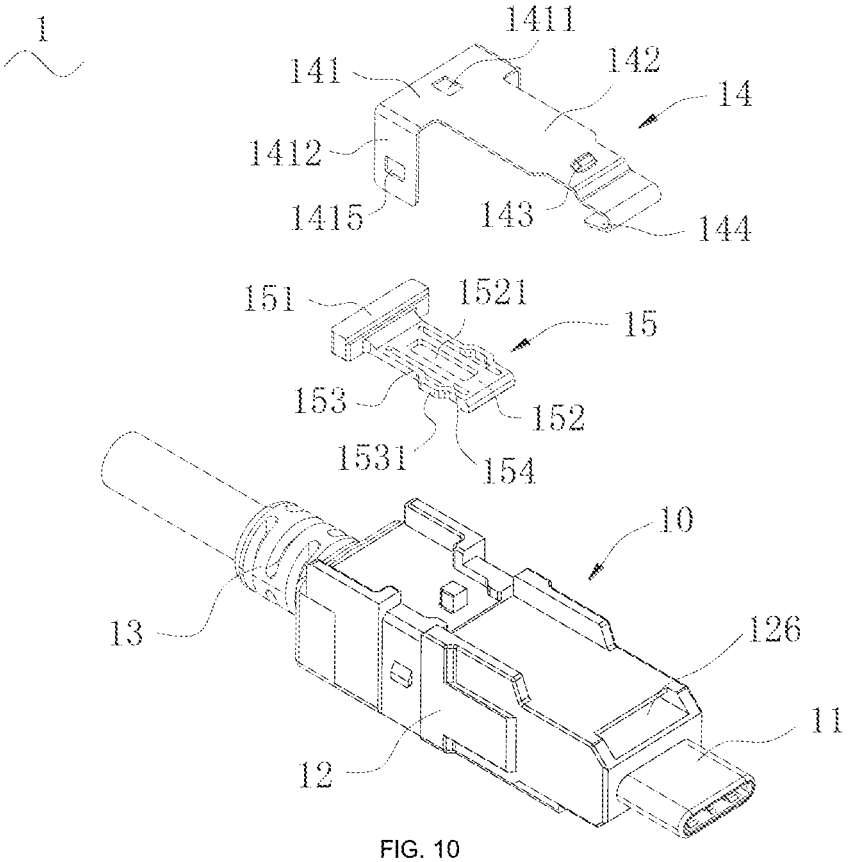
FIG. 10 is a perspective exploded view of a first connector of FIG. 9.

As shown in FIG. 10, the first connector 1 of the preferred embodiment includes a connector main body 10, an elastic latching member 14 and the position assurance slider 15. The connector main body 10 includes a first connector assembly 11, a housing 12 sheathing the first connector assembly 11 therein and an insulating cover 13 covering a rear end of the first connector assembly 11. The elastic latching member 14 and the position assurance slider 15 are correspondingly provided to an upper surface of the housing 12, the position assurance slider 15 can slide in the front-rear direction between the housing 12 and the elastic latching member 14.

Figure 11:
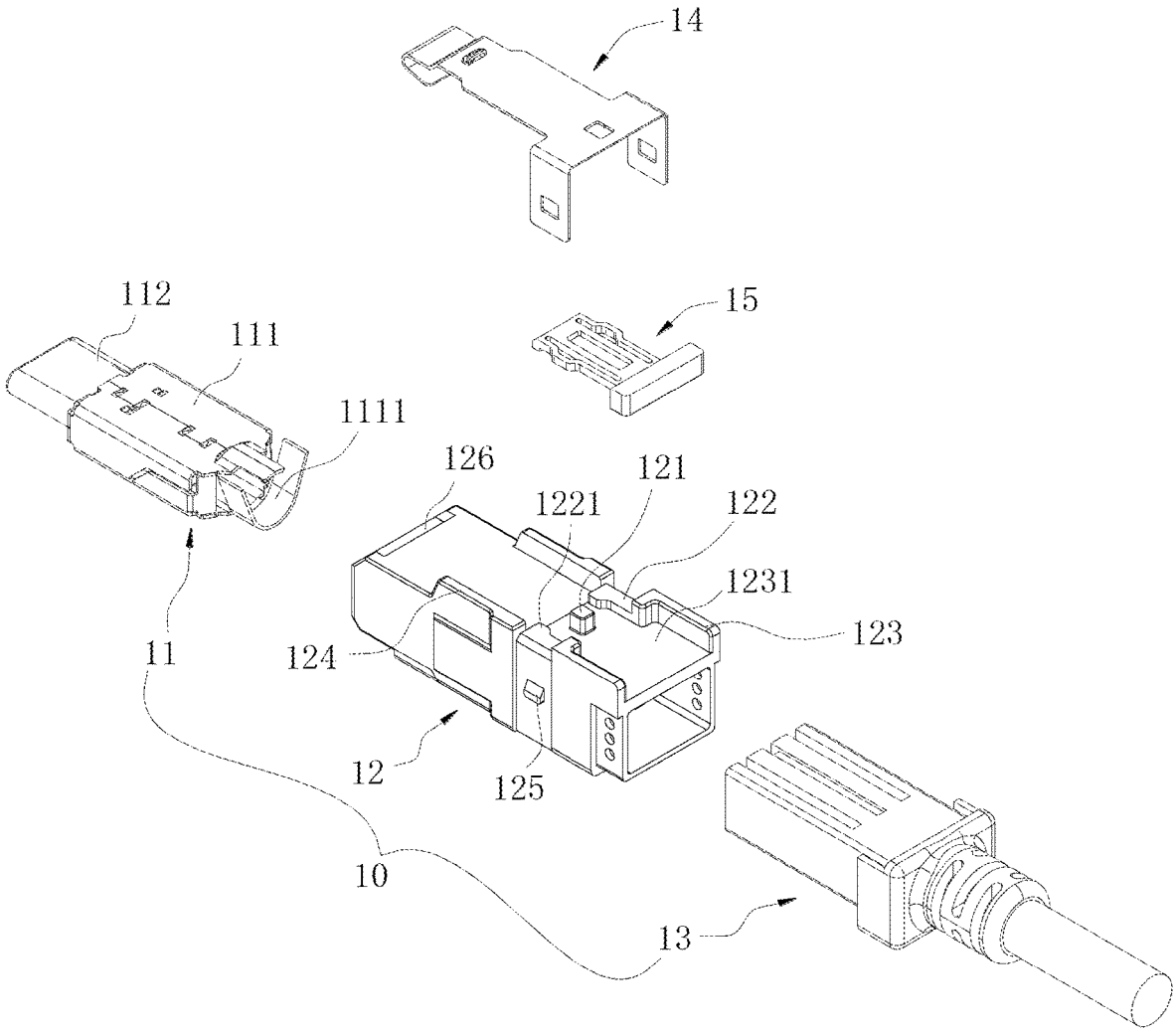
FIG. 11 is a perspective view further exploded on a basis of FIG. 10 and viewed from another angle.

Referring to FIG. 11, the first connector assembly 11 of the preferred embodiment is the USB-C form, and generally includes a shielding shell 111 and a plug 112 provided in the shielding shell 111, the plug 112 extends forwardly out of the shielding shell 111 to be used to mate with the second connector 2. A rear end of the shielding shell 111 is provided with a holding portion 1111 to hold a cable inserted into the shielding shell 111 and electrically connected with the plug 112 (not shown). Other specific structures of the first connector assembly 11 may refer to relevant technologies, the description thereof is not repeated herein. Based on different interface form, the first connector assembly 11 correspondingly may have different structure.

In combination with FIG. 10 and FIG. 11, the housing 12 has a hollow rectangular cylinder shape penetrating in the front-rear direction, sheathes the shielding shell 111 therein, a front end opening of the housing 12 allows the plug 112 to extend out, a rear end opening of the housing 12 allows the cable to pass through.

A positioning post 121 protrudes upwardly from the upper surface of the housing 12 and two locking protrusions 122 are respectively provided at two sides of the positioning post 121 on the upper surface of the housing 12. The positioning post 121 is positioned at a center of the housing 12 in a width direction. The locking protrusion 122 extends along in the front-rear direction, outer side surfaces of the two locking protrusions 122 each are flush with a side surface of the housing 12, two locking protruding portions 1221 respectively protrude from inner sides of front ends of the two locking protrusion 122 toward each other. The locking protruding portion 1221 generally has a right angle trapezoid shape, a front end of the locking protruding portion 1221 corresponds to a right angle loin of the right angle trapezoid shape and is a plane perpendicular to the front-rear direction, a rear end surface of the locking protruding portion 1221 is an inclined surface inclined inwardly from the rear to the front.

Furthermore, two rear positioning ribs 123 further protrude from the upper surface of the housing 12 behind the locking protrusion 122. The rear positioning rib 123 has a L shape, a short side of the L shape is connected with the locking protrusion 122, a long side of the L shape extends to an end surface of a rear end of the housing 12 along the front-rear direction, the short sides of the L shapes of the two rear positioning ribs 123 face each other. A receiving slide groove 1231 is formed between the two rear positioning ribs 123; a width of the receiving slide groove 1231 is larger than an interval between the two locking protrusion 122.

Moreover, two front positioning ribs 124 further protrudes from the upper surface of the housing 12 in front of the locking protrusion 122. The front positioning rib 124 extends along in the front-rear direction, and is connected with a front end of the locking protrusion 122, and has a certain distance from a front end surface of the housing 12. An interval between the two front positioning ribs 124 larger than the interval between the two locking protrusion 122.

Both the rear positioning rib 123 and the front positioning rib 124 extend beyond the locking protrusion 122 along both a height direction and the width direction of the housing 12, so that an inward recessed structure is formed at the locking protrusion 122, so as to facilitate positioning of the elastic latching member 14. In addition, a latching protrusion 125 protrudes from each of the two side surfaces of the housing 12, the latching protrusions 125 and the positioning post 121 generally are in a same vertical cross section. A snapping groove 126 is further is provided to a front end of the housing 12, an opening of the snapping groove 126 faces toward the front.

Still referring to FIG. 10 and FIG. 11, a front end of the insulating cover 13 is inserted into the housing 12, a rear end of the insulating cover 13 is exposed to behind the housing 12, the insulating cover 13 is used to cover a connection location between the first connector assembly 11 and the cable, thereby protecting the connection location. The insulating cover 13 may be injection molded using plastic.

Figure 12:
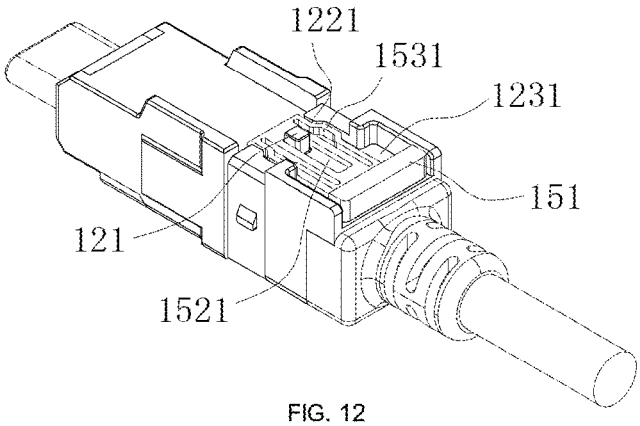
FIG. 12 is a schematic view of a cooperative structure that a position assurance slider of FIG. 9 is mounted on connector main body, with an elastic latching member removed.

Referring to FIG. 10 and FIG. 12, the position assurance slider 15 includes a base 151, a tongue 152 extending forwardly from the base 151 and two locking portions 153 respectively provided at two sides of the tongue 152. The position assurance slider 15 preferably is integrally injection molded by plastic material.

The base 151 generally has a rectangular cylinder shape, is used to allow an operator to operate to make the position assurance slider 15 slide in the front-rear direction. The base 151 is received in the receiving slide groove 1231 of the housing 12, and can slide along the receiving slide groove 1231 in the front-rear direction.

The tongue 152 has a plate shape, a thickness of the tongue 152 is less than a thickness of the base 151. The tongue 152 is provided with a positioning groove 1521 extending in the front-rear direction, a width of the positioning groove 1521 is suitable to a width of the positioning post 121 so as to be used for sliding fit with the positioning post 121, an extending direction of the positioning groove 1521 guides the position assurance slider 15, assures that the position assurance slider 15 can stably slide in the front-rear direction, and defines limit positions of sliding of the position assurance slider 15 in the front-rear direction.

The locking portion 153 generally has a long strip shape extending along the front-rear direction. The two locking portions 153 is symmetrically positioned at two sides of the tongue 152, and positioned at a same plane with the tongue 152, two ends of the locking portion 153 are respectively connected with the tongue 152, and a partitioning groove 154 is between a main body portion of the locking portion 153 and the tongue 152 so as to allow that the locking portion 153 may elastically deform inwardly along the width direction. The two locking portions 153 each are provided with a latching portion 1531 which protrudes outwardly and is used to latch with the locking protruding portion 1221, so that the locking state or the non-locking state is determined.

In the preferred embodiment, the latching portion 1531 has a trapezoid shape, a front end and a rear end of the trapezoid shape are inclined surfaces, so as to facilitate squeezing and contacting with the locking protruding portion 1221 during sliding of the latching portion 1531 in the front-rear direction to make the locking portion 153 elastically deformed.

Continuingly referring to FIG. 10, the elastic latching member 14 preferably is a metal bending member, and includes a fixing portion 141, an elastic portion 142 extending forwardly from the fixing portion 141, the latching hook 143 protruding upwardly at a middle portion of the elastic portion 142 and an abutting portion 144 further bending back from a front end of the elastic portion 142 and further extending.

The fixing portion 141 has a planar sheet shape, extends along the width direction of the housing 12, and is provided with a positioning hole 1411 which is used to cooperate with the positioning post 121 of the housing 12 to be fixed. Preferably, a lateral fixing piece 1412 bends downwardly from each of left and right sides of the fixing portion 141. The lateral fixing piece 1412A is provided with a latching hole 1415 which is used to cooperate with the latching protrusion 125 of the housing 12 to be fixed, so as to make engagement between the elastic latching member 14 and the housing 12 firmer.

The elastic portion 142 generally has a planar sheet shape, extends forwardly from a front side edge of the fixing portion 141, a width of the elastic portion 142 is less than a length of the fixing portion 141. The middle portion of the elastic portion 142 tapers in width relative to a rear portion of the elastic portion 142, a front portion of the middle portion of the elastic portion 142 slightly bends downwardly and then continuously extends forwardly.

The latching hook 143 preferably may be formed from stamping the middle portion of the elastic portion 142 to protrude upwardly, and has a better latching strength.

The abutting portion 144 further bends back from the front end of the elastic portion 142, that is, bends rearwardly and downwardly from a front end edge of the elastic portion 142. The abutting portion 144 abuts against the snapping groove 126 of the housing 12, which provides a support for a tip of the elastic portion 142 and makes the elastic latching member 14 have better elasticity.

Together referring to FIG. 9 and FIG. 10, the elastic latching member 14 covers the housing 12, and limit the position assurance slider 15 in position along an up-down direction. The positioning post 121 of the housing 12 is inserted into and fixed in the positioning hole 1411 of the fixing portion 141 and the two latching protrusions 125 of the housing 12 respectively latch with fixes with the latching holes 1415 of the corresponding lateral fixing pieces 1412, so the elastic latching member 14 is fixedly mounted on the housing 12. And the fixing portion 141 and the lateral fixing pieces 1412 are interposed between the front positioning ribs 124 and the rear positioning ribs 123 of the housing 12 in the front-rear direction, which functions auxiliary limitation in position. The elastic portion 142 is suspended above the upper surface of the housing 12, pressing the elastic portion 142 down makes the elastic portion 142 displace downwardly and in turn makes the elastic portion 142 bring the latching hook 143 move downwardly, but such external pressing force is released, the elastic portion 142 again elastically restores to bring the latching hook 143 move upwardly. The elastic portion 142 is interposed between the two front positioning ribs 124 along the width direction of the housing 12, the two front positioning ribs 124 protect two sides of the elastic portion 142, which thus prevents the elastic portion 142 from being accidently hit by an external force from a side direction. The abutting portion 144 abuts against the snapping groove 126 of the housing 12, which assures whole strength and elasticity of the elastic latching member 14.

An assembling process of The first connector 1 generally is: making the housing 12 sheathing the first connector assembly 11 therein, forming the insulating cover 13 at the rear end of the housing 12, so constituting the connector main body 10; mounting the position assurance slider 15 on the housing 12 to make the positioning groove 1521 of the position assurance slider 15 sheathe the positioning post 121 of the housing 12 therein and make the base 151 received in the receiving slide groove 1231; finally mounting the elastic latching member 14 onto the housing 12 to make the abutting portion 144 of the elastic latching member 14 abut against the snapping groove 126 of the housing 12 and make the fixing portion 141 engaged and fixed with the positioning post 121 and the two lateral fixing piece 1412 respectively engaged and fixed with the two latching protrusions 125.

Figure 13:
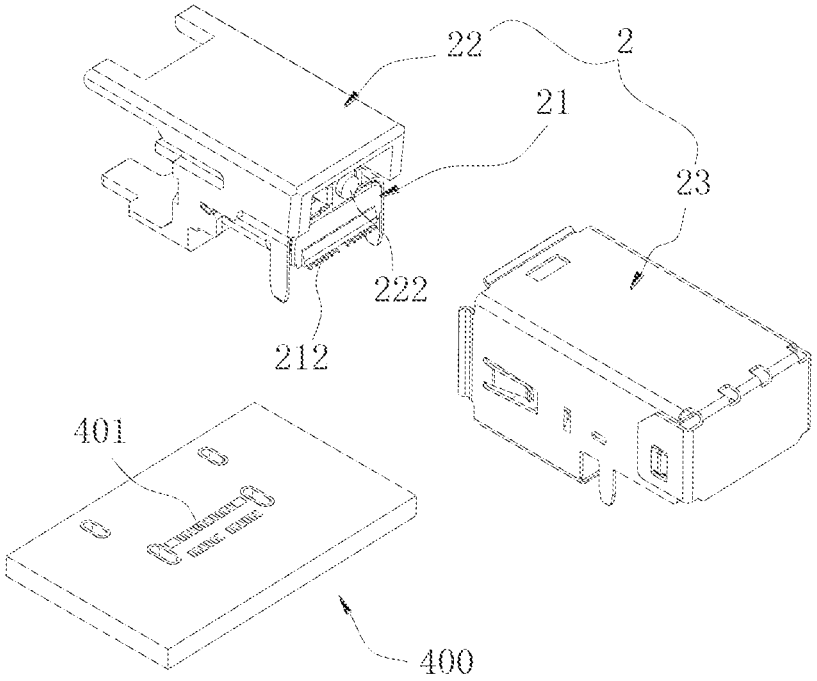
FIG. 13 is a perspective exploded view FIG. 9 of a second connector and a circuit board, with an outer shielding shell separated.
Figure 14:
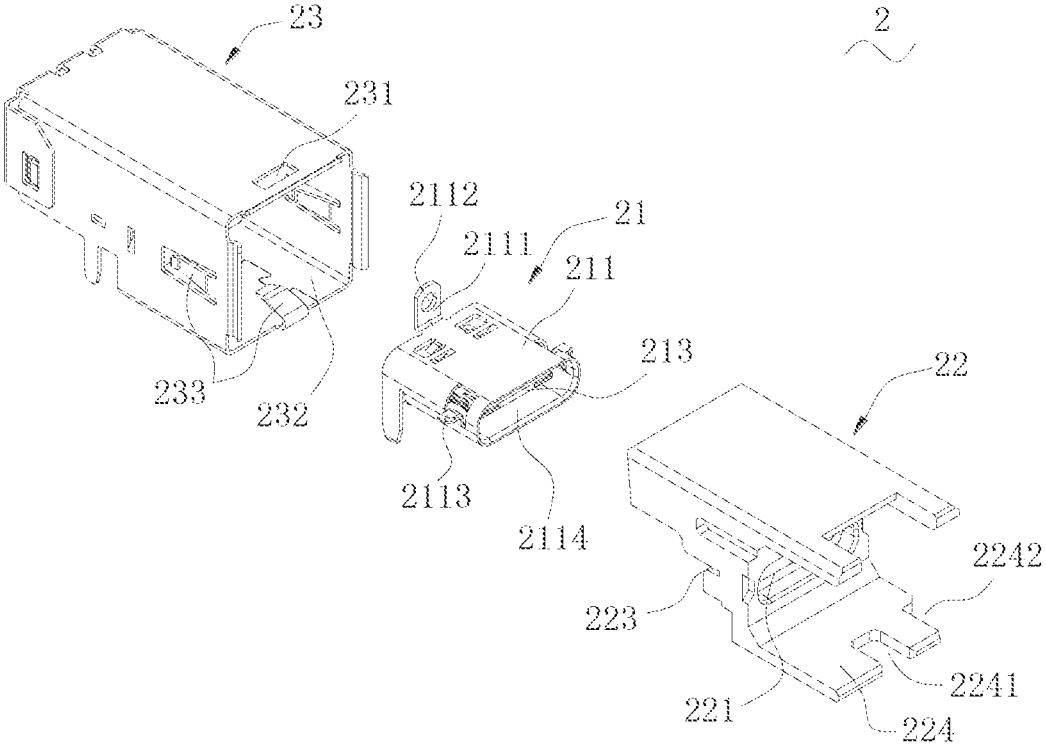
FIG. 14 is a perspective view of the second connector of FIG. 13 further exploded and viewed from another angle.

Referring to FIG. 9, FIG. 13 and FIG. 14, the second connector 2 of the preferred embodiment includes a second connector assembly 21, a fixing shell 22 fixed to the second connector assembly 21 and an outer shielding shell 23 sheathing the fixing shell 22 therein.

In the preferred embodiment, the second connector assembly 21 is a USB-C receptacle which is matched with the first connector assembly 11, and generally includes an insulating base 213, a plurality of conductive terminals 212 fixed to the insulating base 213 and a metal shell 211 sheathing the insulating base 213 therein. Rear ends of the plurality of conductive terminals 212 extend out of the insulating base 213 to be used to be correspondingly soldered with a plurality of solder pads 401 on the circuit board 400. A mating cavity 2114A is formed in a front end of the metal shell 211 to allow the plug 112 of the first connector assembly 11 to mate therewith. A fixing tab 2111 bends upwardly from a rear end of the metal shell 211, the fixing tab 2111 is provided with a fixing hole 2112, a fixing rib 2113 horizontally bends outwardly and protrudes from each of two sides of the front end of the metal shell 211.

The fixing shell 22 is preferably injection molded by plastic, is provided with a receiving hole 221 extending in the front-rear direction, two sides of a rear surface of the fixing shell 22 each is provided with a fixing groove 223 extending in the front-rear direction. The fixing shell 22 is fixed around an outer periphery of the metal shell 211, the front end of the metal shell 211 is received in the receiving hole 221, the fixing ribs 2113 are inserted into the corresponding fixing grooves 223 respectively.

A fixing post 222 extends rearwardly from the fixing shell 22 above the receiving hole 221, the fixing tab 2111 of the metal shell 211 is fixed on the fixing post 222 through the fixing hole 2112, specifically, it may be done by making the fixing hole 2112 sheathe the fixing post 222 therein, heat melting an end portion of the fixing post 222 to make the fixing tab 2111 and the fixing post 222 engaged and fixed.

In the second connector 2, by cooperation between the receiving hole 221 of the fixing shell 22 and the metal shell 211 in positioning and cooperation between the fixing grooves 223 of the fixing shell 22 and the fixing ribs 2113 of the metal shell 211, assembling of the fixing shell 22 and the second connector assembly 21 is simple, convenient and fast. Also, the fixing ribs 2113 horizontally bend, and the fixing grooves 223 are extended on the rear surface of the fixing shell 22 in the front-rear direction, which facilitate assembling and positioning of the metal shell 211 and the fixing shell 22 in the front-rear direction. Furthermore, further by engagement between the fixing tab 2111 and the fixing post 222, the fixing shell 22 and the second connector assembly 21 are firmly engaged together, the structure is simple and reliable.

The outer shielding shell 23 is metal material, surrounds an outer periphery and a rear side of the fixing shell 22 and the second connector assembly 21, and functions as shielding signal interference. A locking cavity 232 is formed in a front end of the outer shielding shell 23, a bottom and two sides of a front end of the outer shielding shell 23 each is provided with an elastic piece 233 elastically bending toward the locking cavity 232 to guide the first connector 1 to insert into and mate with and hold the housing 12 of the first connector 1, which facilitates mating between the first connector 1 and the second connector 2 and maintaining the mated state.

The elastic piece 233 positioned at the bottom of the outer shielding shell 23 bends upwardly, and protrudes upwardly from a recessed groove 2241 of the fixing shell 22. A top portion of the front end of the outer shielding shell 23 is provided with the latching aperture 231.

Based on the above description on the specific structures of the first connector 1 and the second connector 2, again referring to FIG. 1 to FIG. 8, when the first connector 1 and the second connector 2 are mated with each other, the plug 112 of the first connector 1 is inserted into the mating cavity 2114 of the second connector 2, which makes the first connector assembly 11 and the second connector assembly 21 electrically connected. At the same time, the front end of the housing 12 of the first connector 1 is inserted into the locking cavity 232 of the second connector 2, the latching hook 143 of the elastic latching member 14 is latched with the latching aperture 231 of the outer shielding shell 23 to realize locking. The elastic piece 233 at the bottom of the outer shielding shell 23 upwardly abuts against the housing 12 of the first connector 1, and cooperates with the latching hook 143 to fix the housing 12 of the first connector 1 from two sides in the up-down direction, which makes locking of the first connector 1 and the second connector 2 firmer.

At this time, the position assurance slider 15 is positioned between the housing 12 and the elastic latching member 14 and can slide in the front-rear direction and, by changing the position of the position assurance slider 15 in the front-rear direction, the elastic latching member 14 can be in a locking state or a non-locking state.

Figure 3:
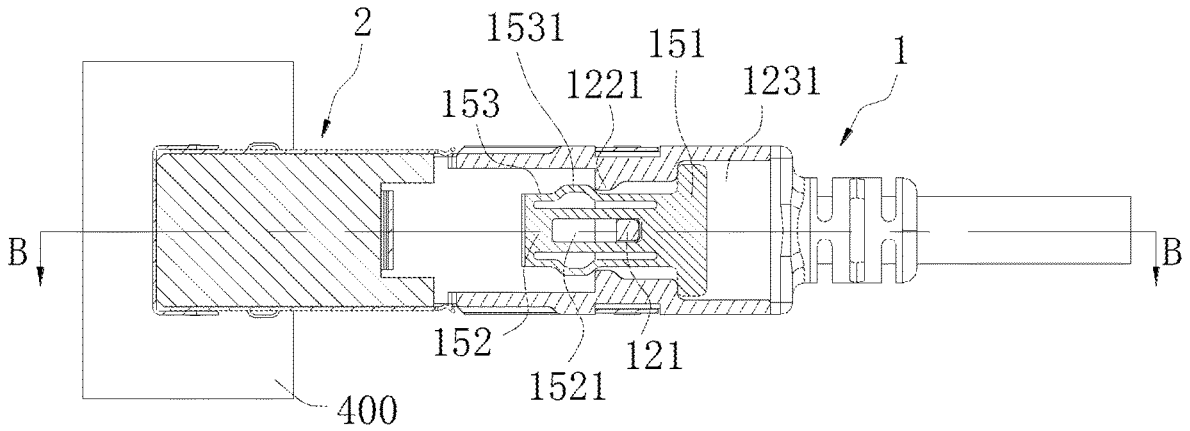
FIG. 3 is a cross sectional view taken along a line A-A of FIG. 2.
Figure 4:
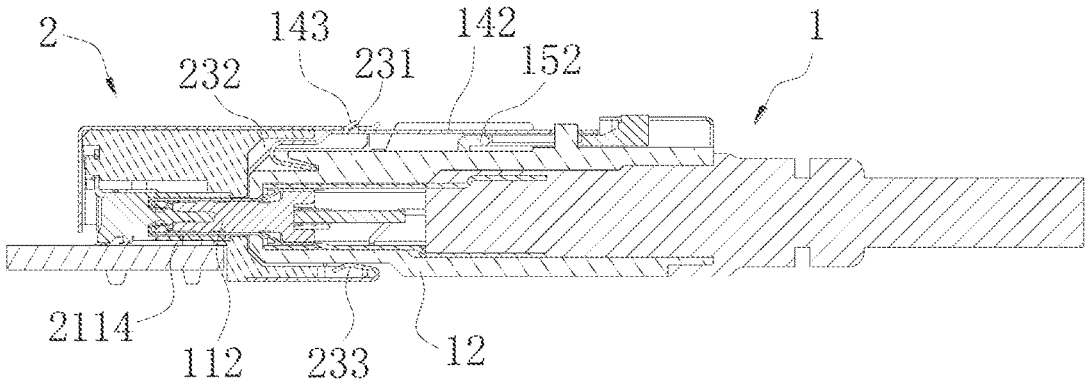
FIG. 4 is a cross sectional view taken along a line B-B of FIG. 3.
Figure 5:
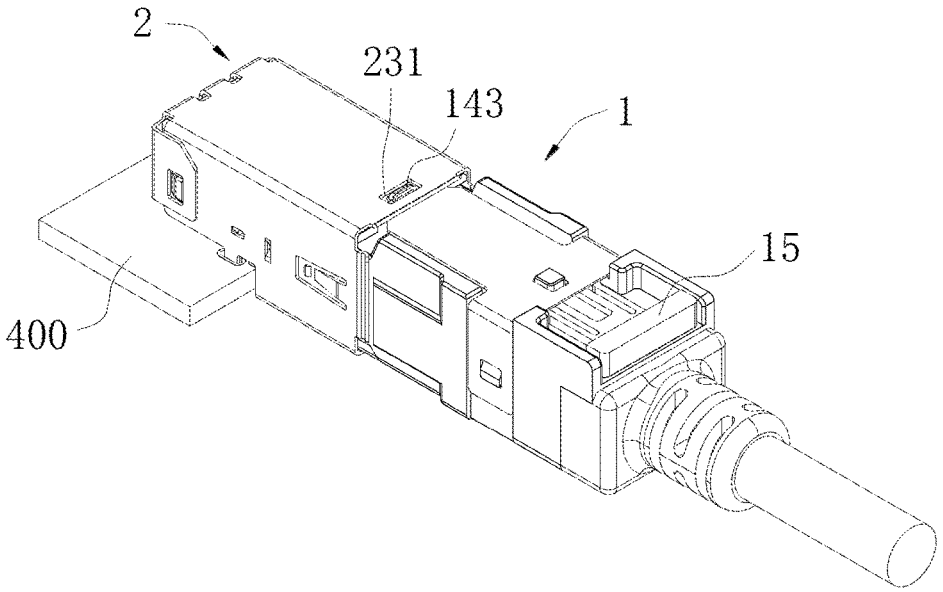
FIG. 5 is a perspective view of the electrical connector assembly engaged together and in a non-locking state of FIG. 1.
Figure 6:
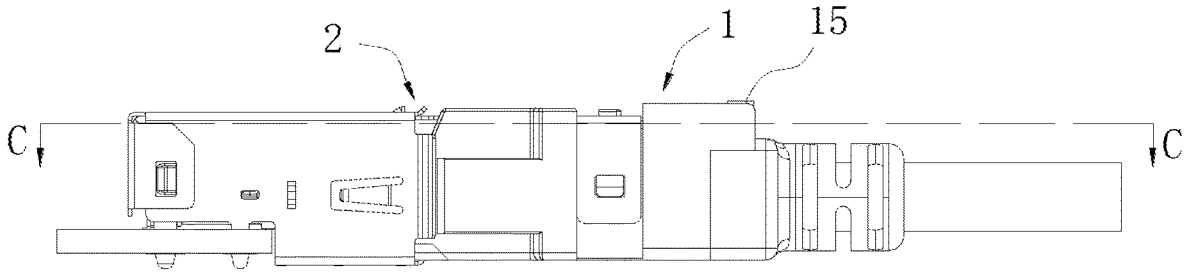
FIG. 6 is a front view of FIG. 5.

FIG. 3 and FIG. 4 schematically illustrate the locking state. First referring to FIG. 3, at this time, the position assurance slider 15 is positioned at a front limit position, the base 151 is positioned at the most front end of the receiving slide groove 1231, the positioning post 121 is positioned at a rear end of the positioning groove 1521. At this time, the latching portion 1531 of the locking portion 153 is positioned in front of the locking protruding portion 1221, and is latched with the front end of the locking protruding portion 1221, so that the position assurance slider 15 is fixed at the front limit position.

Again referring to FIG. 4, in the locking state, the tongue 152 of the position assurance slider 15 abuts against the elastic portion 142 of the elastic latching member 14 from below, thus can block the elastic portion 142 from moving downwardly, so the latching hook 143 will be difficult to move downwardly to release latching relationship with the latching aperture 231. At this time, the first connector 1 and the second connector 2 can be firmly locked together, and is not easily affected by an external force.

Figure 7:
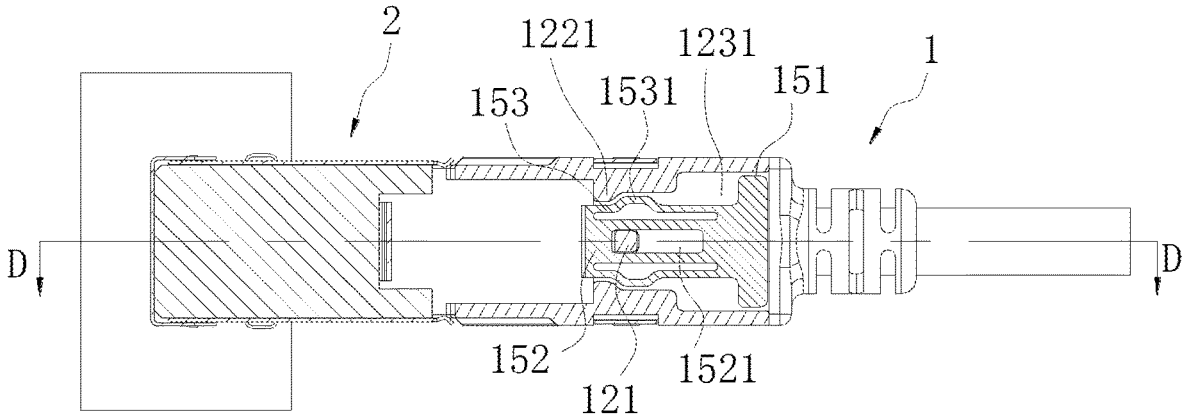
FIG. 7 is a cross sectional view taken along a line C-C of FIG. 6.
Figure 8:
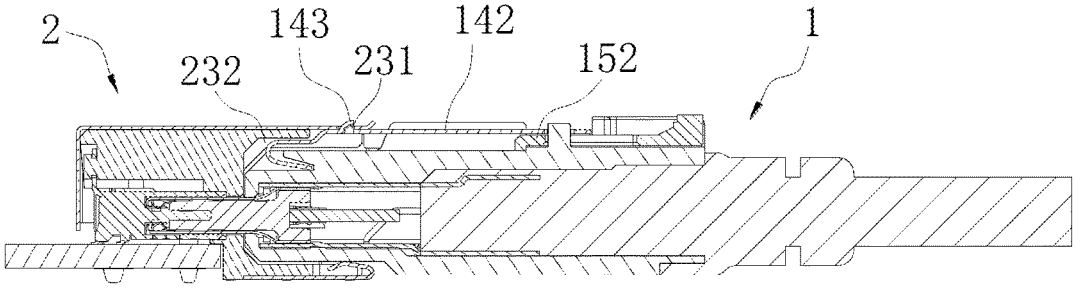
FIG. 8 is a cross sectional view taken along a line D-D of FIG. 7.

FIG. 7 and FIG. 8 schematically illustrate the non-locking state. As shown in FIG. 7, at this time the position assurance slider 15 is positioned at a rear limit position, the base 151 is positioned at the most rear end of the receiving slide groove 1231, the positioning post 121 is positioned at a front end of the positioning groove 1521. At this time, the latching portion 1531 of the locking portion 153 is positioned behind the locking protruding portion 1221, and is latched with a rear end of the locking protruding portion 1221, so that the position assurance slider 15 is fixed at the rear limit position.

Again referring to FIG. 8, in the non-locking state, the tongue 152 of the position assurance slider 15 is rearwardly withdrawn, does not block the elastic portion 142 from moving downwardly. When the elastic portion 142 is pressed down, that is, the elastic portion 142 will bring the latching hook 143 to move downwardly and release the latching relationship with the latching aperture 231, further applying a force toward the rear, the first connector 1 can be pulled out, the electrical connection between the first connector 1 and the second connector 2 is released.

Comparatively referring to FIG. 3 and FIG. 7, switching between the locking state and the non-locking state of the elastic latching member 14 is realized by changing the position of the position assurance slider 15 in the front-rear direction. Taking the locking state of FIG. 3 as an initial state, the position assurance slider 15 is pulled rearwardly, the locking portion 153 is elastically deformed inwardly because the latching portion 1531 is squeezed by the locking protruding portion 1221. When the position assurance slider 15 moves rearwardly to the non-locking state of FIG. 7, the latching portion 1531 moves to behind the locking protruding portion 1221, the locking portion 153 elastically restores, so that the non-locking state is maintained. On the contrary, taking the non-locking state of FIG. 7 as an initial state, the position assurance slider 15 is pushed forwardly, the locking portion 153 is elastically deformed inwardly, until the latching portion 1531 moves to in front of the locking protruding portion 1221, which makes the elastic latching member 14 in the locking state.

According to the above description, it can be seen that, in the first connector 1 of the preferred embodiment, using the latching hook 143 of the elastic latching member 14 realizes firm connection with the latching aperture 231 of the second connector 2 which mates with the first connector 1; by adjusting the position of the position assurance slider 15 in the front-rear direction, the elastic latching member 14 can be allowed to be in the locking state or is in the non-locking state. In the locking state, it assures that the latching hook 143 does not release the latching connection with the latching aperture 231, realizes firm locking connection between the first connector 1 and the second connector 2. In the non-locking state, by pressing the elastic portion 142 down, the latching connection between the latching hook 143 and the latching aperture 231 can be released, which facilitate separation of the first connector 1 and the second connector 2 from each other.

The elastic latching member 14 and the position assurance slider 15 are positioned by the positioning post 121 and the locking protrusions 122 protruding from the housing 12, which makes the structure simple and facilitates assembling. The fixing portion 141 of the elastic latching member 14 is mounted on the housing 12, the elastic portion 142 is suspended above the housing 12, in comparison with a latching structure which is integrally provided on a housing, the elastic latching member 14 made of a metal has better elasticity and latching strength, which facilitates realization of firmer locking connection. By the sliding fit between the positioning groove 1521 of the position assurance slider 15 and the positioning post 121, the position assurance slider 15 can realize stable sliding in the front-rear direction, by cooperation between the locking portion 153 of the position assurance slider 15 and the locking protrusion 122, the position of the position assurance slider 15 in the front-rear direction can be fixed, the stability of the locking state is assured, firmness of the locking connection is assured.

Figure 15:
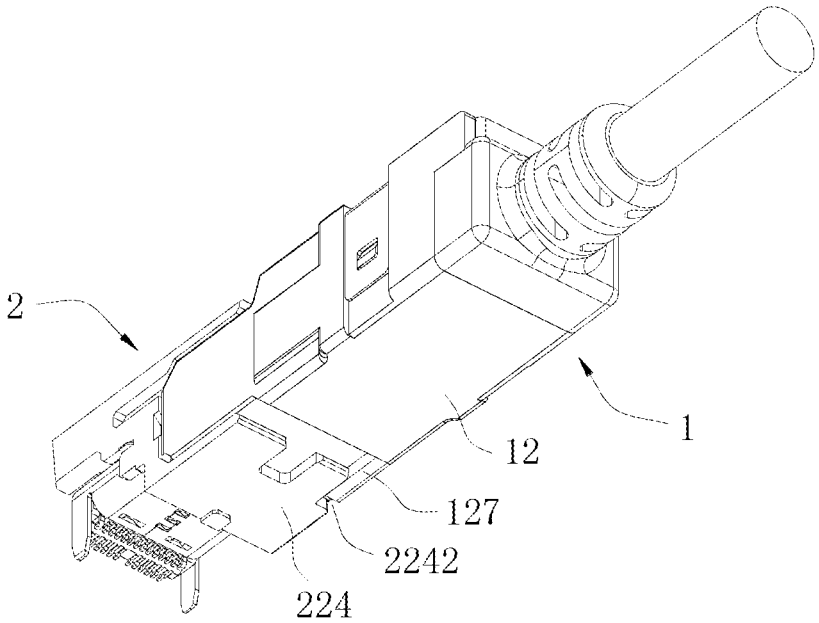
FIG. 15 is a bottom structure schematic view of a preferred embodiment of the electrical connector assembly of the present disclosure, with the outer shielding shell of the second connector removed.

Again engaged referring to FIG. 14 and FIG. 15, in a preferred embodiment of the present disclosure, a protruding plate 224 further extends forwardly from a bottom of the fixing shell 22 of the second connector 2, a recessed groove 2241 is provided in a middle portion of a front end of the protruding plate 224, a mistake proof groove 2242 is provided at a side edge of the protruding plate 224.

Cooperating with a structure with the protruding plate 224 of the fixing shell 22 in the second connector 2, a bottom of the housing 12 in the first connector 1 is further provided with a mistake proof rib 127 protruding. When the first connector 1 and the second connector 2 are mated with each other, the mistake proof rib 127 is correspondingly inserted into the mistake proof groove 2242 of the protruding plate 224.

Figure 16:
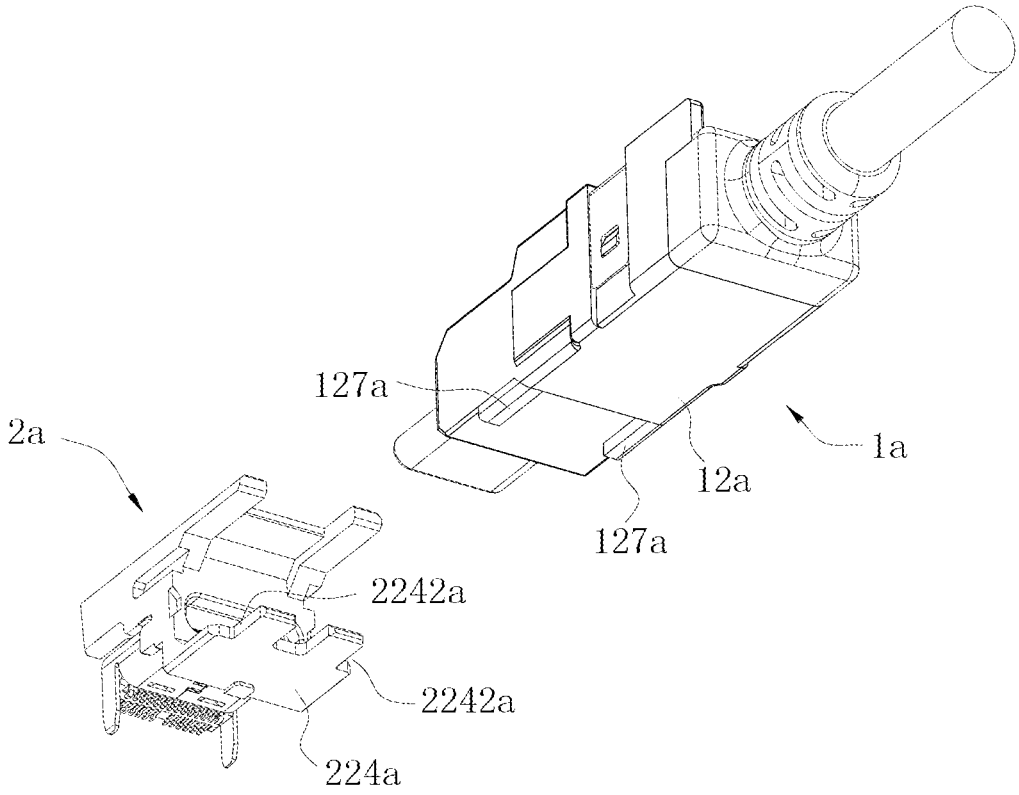
FIG. 16 is a bottom structure schematic view of an electrical connector assembly of another preferred embodiment, with an outer shielding shell of the second connector removed similarly.

Again referring to FIG. 16, in another preferred embodiment, the protruding plate 224*a* of second connector 2*a* is provided with two mistake proof grooves 2242*a*, the two mistake proof grooves 2242*a* are positioned at two side edges of the protruding plate 224*a* respectively. Correspondingly, a bottom of the housing 12*a* of the first connector 1*a* is provided with two mistake proof ribs 127*a* spaced apart from each other. When the first connector 1*a* and the second connector 2*a* are mated with each other, the two mistake proof ribs 127*a* are inserted into the two mistake proof grooves 2242*a* respectively.

The structure and position of the above mistake proof rib 127/127*a* is correspondingly matched with the structure and position of the protruding plate 224/224*a* of mistake proof groove 2242/2242*a*, mating cannot be achieved in a non-matching case, so as to assure that one type of the first connector 1/1*a* can only be mated with one type of the second connector 2/2*a*, which is matched with the one type of the first connector 1/1*a*, so that when there is various type of the first connector and the second connector, it assures that only the first connector and the second connector which have corresponding mistake proof structures can be correspondingly mated together.

In other embodiments not shown, the mistake proof rib and the mistake proof groove each are not limited to be provided on the bottom of the respective connector, and the specific structure and arrangement manner of the mistake proof rib and the mistake proof groove also are not limited to the two type given as above, may be flexibly arranged according to practical conditions, as long as it assures that the mistake proof rib in the first connector is matched with the mistake proof groove of the second connector which is mated with the first connector, so that it avoids wrong mating of the first connector and the second connector which are not matched with each other occurring, and assures correct mating of the first connector and the second connector.

The above described contents are only the preferred embodiments of the present disclosure, which cannot limit the implementing solutions of the present disclosure, those skilled in the art may conveniently make corresponding variation or modification based on the main concept and spirit of the present disclosure, therefore the extent of protection of the present disclosure shall be determined by terms of the Claims.

What is claimed is:

1. A first connector, which can be correspondingly mated with a second connector, and comprises:

a connector main body, which comprises a first connector assembly and a housing sheathing the first connector assembly therein; a positioning post protruding upwardly from an upper surface of the housing and two locking protrusions positioned at two sides of the positioning post on upper surface of the housing; two locking protruding portions protruding from inner sides of the two locking protrusions respectively;

an elastic latching member, which comprises a fixing portion, an elastic portion extending forwardly from the fixing portion and a latching hook provided at a front end of the elastic portion; the fixing portion being provided with a positioning hole to allow the positioning post to be fixed therein; the elastic portion being suspended above the upper surface of the housing; and a position assurance slider, which is positioned between the housing and the elastic latching member and can slide in a front-rear direction; the position assurance slider comprising a base, a tongue extending forwardly from the base and two locking portions provided at two sides of the tongue; the tongue being provided with a positioning groove which extends in the front-rear direction and allows the positioning post to be positioned therein and allows the positioning post to relatively slide therein; during sliding of the locking portion in the front-rear direction, the locking portion cooperating with the locking protruding portion so that the elastic latching member being in a locking state or a non-locking state; when the elastic latching member is in the locking state, the tongue being positioned below the elastic portion so as to prevent the elastic portion from moving downwardly, to prevent unlatching of the latching hook.

2. The first connector according to claim 1, wherein the elastic latching member is made of a metal, an abutting portion further bends back from the front end of the elastic portion, the abutting portion abuts against the housing, wherein the latching hook protrudes upwardly from the elastic portion.

3. The first connector according to claim 1, wherein a lateral fixing piece downwardly bends from each of two sides of the fixing portion of the elastic latching member, the two lateral fixing pieces each are provided with a latching hole; a latching protrusion is provided on each of two side surfaces of the housing, the latching protrusion and the corresponding latching hole are engaged with each other.

4. The first connector according to claim 1, wherein a partitioning groove is provided between the locking portion and the tongue of the position assurance slider to allow the locking portion to be elastically deformed inwardly, a latching portion protrudes outwardly from the locking portion, the latching portion and the locking protruding portion of the housing are correspondingly latched with each other.

5. The first connector according to claim 1, wherein when the elastic latching member is in the locking state, the positioning post is positioned at a rear end of the positioning groove; and when the elastic latching member is in the non-locking state, the positioning post is positioned at a front end of the positioning groove.

6. The first connector according to claim 1, wherein two front positioning ribs are further correspondingly provided on the upper surface of the housing in front of the two locking protrusions, the two front positioning ribs are provided at two sides of the elastic portion of the elastic latching member respectively and make the elastic portion interposed therebetween.

7. An electrical connector assembly, comprising the first connector of claim 1 and the second connector which is matched with the first connector;

the second connector comprising a second connector assembly, a fixing shell used to fix the second connector assembly and an outer shielding shell sheathing the fixing shell therein, a locking cavity is formed in a front end of the outer shielding shell, a top portion of the outer shielding shell being provided with a latching aperture;

when the first connector and the second connector is mated with each other, a front end of the housing of the first connector being inserted into the locking cavity, the latching hook of the elastic latching member being latched upwardly with the latching aperture, so that the first connector and the second connector being locked together.

8. The electrical connector assembly according to claim 7, wherein an elastic piece bends upwardly from a bottom of the outer shielding shell, the elastic piece upwardly abuts against the housing of the first connector, so that the elastic piece cooperates with the latching hook of the elastic latching member to fix the housing of the first connector.

9. The electrical connector assembly according to claim 7, wherein a protruding plate extends forwardly from the fixing shell of the second connector, the protruding plate is provided with at least one mistake proof groove;

at least one mistake proof rib protrudes from the housing of the first connector, the at least one mistake proof rib is correspondingly inserted into the at least one mistake proof groove.

10. An electrical connector assembly, comprising the first connector of claim 1 and the second connector which is matched with the first connector;

the second connector comprising a second connector assembly, a fixing shell used to fix the second connector assembly and an outer shielding shell sheathing the fixing shell therein, a locking cavity is formed in a front end of the outer shielding shell, a protruding plate extending forwardly from the fixing shell, the protruding plate being provided with at least one mistake proof groove;

when the first connector and the second connector are mated with each other, a front end of the housing of the first connector being inserted into the locking cavity inside; at least one mistake proof rib protruding from the housing of the first connector, the at least one mistake proof rib being correspondingly inserted into the at least one mistake proof groove.

11. The electrical connector assembly according to claim 10, wherein an elastic piece protrudes from bottom and two sides of the outer shielding shell toward the locking cavity respectively, when the first connector and the second connector are mated with each other, the elastic pieces elastically abut against the housing of the first connector.

12. The electrical connector assembly according to claim 11, wherein a middle portion of the protruding plate is provided with a recessed groove, the elastic piece positioned at the bottom of the outer shielding shell protrudes upwardly from the recessed groove, and the at least one mistake proof groove is provided at least one side edge of the protruding plate.

13. A second connector, comprising:

a second connector assembly, which comprises an insulating base, a plurality of conductive terminals fixed to the insulating base and a metal shell sheathing the insulating base therein; a fixing rib bending outwardly from each of two sides of the metal shell;

a fixing shell, which is fixed to the second connector assembly, the fixing shell being provided with a receiving hole extending in the front-rear direction, two sides of the fixing shell each being provided with a fixing groove; a front end of the metal shell being received in the receiving hole, the fixing rib of the metal shell being inserted into the corresponding fixing groove; and an outer shielding shell, which sheathes the fixing shell therein, wherein the two fixing ribs horizontally bend outwardly from two sides of the metal shell respectively, the two fixing grooves are extended on a rear surface of the fixing shell in the front-rear direction.

14. The second connector according to claim 13, wherein a fixing tab bends upwardly from a rear end of the metal shell and a fixing hole is positioned on the fixing tab, the fixing hole and the fixing shell are engaged together.

15. The second connector according to claim 14, wherein a fixing post extends rearwardly from the fixing shell, the fixing post and the fixing hole of the metal shell are correspondingly fixed together.

* * * * *